US007448968B1

(12) United States Patent
Petion

(10) Patent No.: US 7,448,968 B1
(45) Date of Patent: Nov. 11, 2008

(54) TRAINING DEVICE FOR SOCCER PLAYERS

(76) Inventor: Jean C. Petion, 109-10 160th St., Jamaica, NY (US) 11433

( * ) Notice: Subject to any disclaimer, the term of this patent is extended or adjusted under 35 U.S.C. 154(b) by 377 days.

(21) Appl. No.: 11/355,542

(22) Filed: Feb. 17, 2006

(51) Int. Cl.
*A63B 69/00* (2006.01)

(52) U.S. Cl. ..... 473/446; 473/422

(58) Field of Classification Search ..... D21/699, D21/698, 705; D20/10; 473/478, 448, 469, 473/422, 446, 447
See application file for complete search history.

(56) References Cited

U.S. PATENT DOCUMENTS

| | | | | |
|---|---|---|---|---|
| 4,492,380 | A * | 1/1985 | Saytar | 473/471 |
| D302,991 | S | 8/1989 | York | |
| 5,217,230 | A * | 6/1993 | Judd | 473/416 |
| 5,524,881 | A * | 6/1996 | Edward | 473/447 |
| 5,725,444 | A | 3/1998 | Heden | |
| 5,746,669 | A | 5/1998 | Sinsheimer et al. | |
| 5,961,403 | A | 10/1999 | Caruso | |
| 6,508,729 | B1 | 1/2003 | Coltrane et al. | |
| 7,311,617 | B2 * | 12/2007 | Langhorn | 473/446 |
| 2003/0228942 | A1 | 12/2003 | Hsieh | |

* cited by examiner

*Primary Examiner*—Gene Kim
*Assistant Examiner*—M Chambers
(74) *Attorney, Agent, or Firm*—Crossley Patent Law; Mark A. Crossley

(57) ABSTRACT

This is a training device for soccer players that uses a plurality of connectors that have a main body and three hollow engagement ports that are angled away from the main body to provide support for the frame. The ends of the frame members fit into the engagement ports and thus engage the frame and support it for use. There is a flexible outer covering that fits over the frame members and supports the ring members that are placed within an opening in the outer covering. There can be one or two rings as desired. The outer covering does not cover the bottom of the frame, and this area can also be used as a target area.

1 Claim, 4 Drawing Sheets

TRAINING DEVICE FOR SOCCER PLAYERS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Many offerings exist by which a soccer players can practice their skills. The devices offered, however, do not solve all problems associated with portability. When the existing goals are used, then the player cannot easily alter the layout should the need arise. If more than one player is practicing, occasionally the goals cannot accommodate the quantity of incoming balls.

FIELD OF THE INVENTION

The present invention relates to a training device for soccer players for use in connection with training soccer players the basics of ball handling. The training device for soccer players has particular utility in connection with teaching close distance aiming and passing skills, as well as long distance aiming and passing skills to children and others desirous of honing their skills.

DESCRIPTION OF THE PRIOR ART

The use of training devices for soccer players is known in the prior art. For example, U.S. Pat. No. 6,508,729 to Coltrane et al. discloses a goal shot training system. However, the Coltrane '729 patent does not afford the user portability, and has further drawbacks of requiring the use of a certain type of goal system, which might not be the standard in the users field.

U.S. Pat. No. 5,746,669 to Sinsheimer et al. discloses a game and training device for teaching soccer skills that uses a series of hoops and a final goal. However, the Sinsheimer '669 patent does not have the structure of the present invention, and additionally does not allow for the ball to pass through the final goal member.

While the above-described devices fulfill their respective and particular objects and requirements, they do not describe a training device for soccer players that provides for the advantages of the present invention; therefore, a need exists for an improved training device for soccer players, particularly one that includes portability, ease of set-up and use, and the ability to be used by one player or multiple players.

In this respect, the present invention substantially departs from the conventional concepts and designs of the prior art.

SUMMARY OF THE INVENTION

In view of the foregoing disadvantages inherent in the known types of training devices for soccer players now present in the prior art, the present invention provides an improved training device for soccer players, and overcomes the above-mentioned disadvantages and drawbacks of the prior art. As such, the general purpose of the present invention, which will be described subsequently in greater detail, is to provide a new and improved training device for soccer players and method which has all the advantages of the prior art mentioned heretofore and many novel features that result in a training device for soccer players which is not anticipated, rendered obvious, suggested, or even implied by the prior art, either alone or in any combination thereof.

To attain this, the present invention essentially comprises a plurality of connection means having a main body and three hollow engagement ports. The engagement ports angle away from the main body. There is a frame that is made from a pair of front and rear frame members, a pair of side frame members, and a pair of upper frame members. The frame members all have opposite ends, and the ends are sized to fit into the hollow portion of the engagement ports, much as tent poles fit into the tent frame connectors. The frame is covered by a flexible outer covering that supports a ring member placed within an opening formed through or within the flexible outer covering. The ring is the aiming area for the soccer player who is training and using the training device.

The outer covering can be made from mesh or fabric, as desired by the manufacturer and end user. The use of these types of covering materials would aide in the use of the training device, as they are lightweight enough to be easily carried and flexible enough to fold and store while the device is in transit or storage.

There has thus been outlined, rather broadly, the more important features of the invention in order that the detailed description thereof that follows may be better understood and in order that the present contribution to the art may be better appreciated.

The invention may also include one or two aiming rings as desired. There are, of course, additional features of the invention that will be described hereinafter and which will form the subject matter of the claims attached. The ring or rings would be connected to the fabric to ensure stability and strength.

It is therefore an object of the present invention to provide a new and improved training device for soccer players that has all of the advantages of the prior art training devices for soccer players and none of the disadvantages.

It is another object of the present invention to provide a new and improved training device for soccer players that may be easily and efficiently manufactured and marketed.

An even further object of the present invention is to provide a new and improved training device for soccer players that has a low cost of manufacture with regard to both materials and labor, and which accordingly is then susceptible of low prices of sale to the consuming public, thereby making such training device for soccer players economically available to the buying public.

Still another object of the present invention is to provide a new training device for soccer players that provides in the apparatuses and methods of the prior art some of the advantages thereof, while simultaneously overcoming some of the disadvantages normally associated therewith.

Even still another object of the present invention is to provide a training device for soccer players for easy portability and set up. This allows the user to train with the device as needed or desired, and not be constrained by the use of existing goals or facilities.

Still yet another object of the present invention is to provide a training device for soccer players for compact and efficient storage. This makes it possible to store the device when not in use.

Thus has been broadly outlined the more important features of the training device for soccer players so that the detailed description thereof that follows may be better understood and in order that the present contribution to the art may be better appreciated.

Numerous objects, features and advantages of the training device for soccer players will be readily apparent to those of ordinary skill in the art upon reading the following detailed description of presently preferred, but nonetheless illustrative, embodiments of the training device for soccer players when taken in conjunction with the accompanying drawings. In this respect, before explaining the current embodiments of the training device for soccer players in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the training device for soccer players. It is therefore important that the claims be regarded as including such equivalent constructions insofar as they do not depart from the spirit and scope of the present invention.

These together with additional objects of the training device for soccer players, along with various novel features that characterize the invention are particularly pointed out in the claims forming a part of this disclosure. For better understanding of the training device for soccer players, its operating advantages and specific objects attained by its uses, refer to the accompanying drawings and description.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGURES

Figure 1:
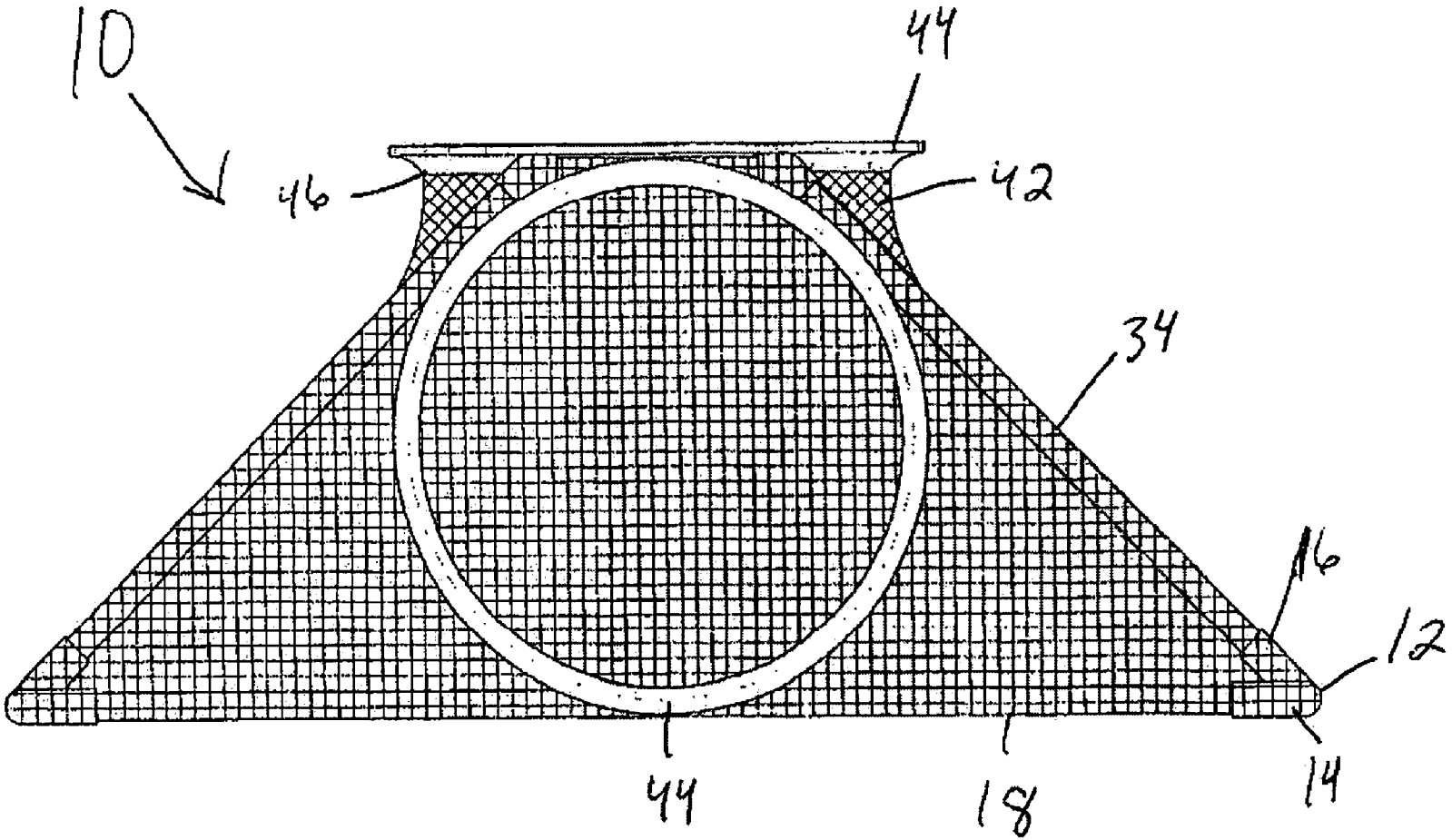

FIG. 1 is a front view of the preferred embodiment of the training device for soccer players constructed in accordance with the principles of the present invention.

Figure 2:
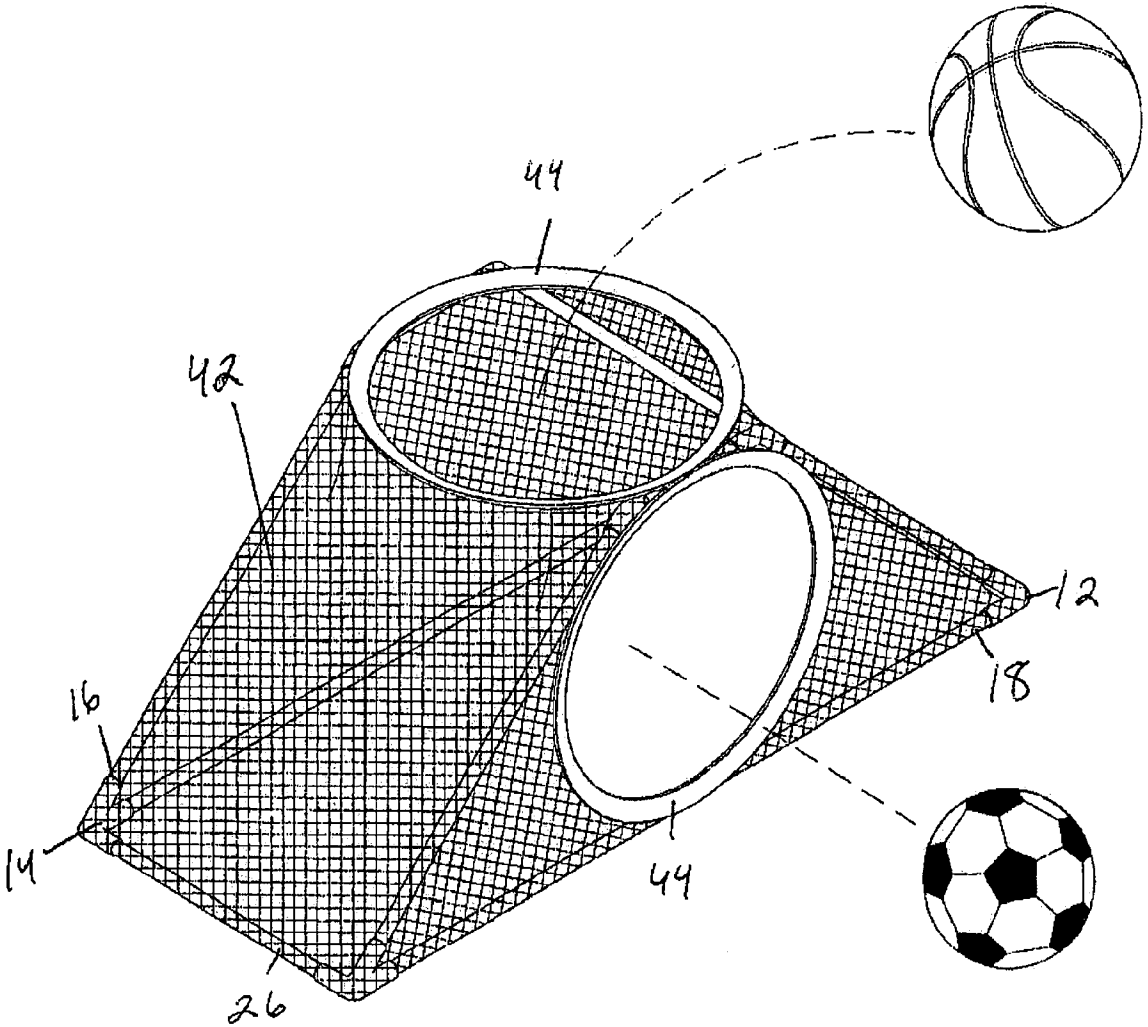

FIG. 2 is a left perspective view of the training device for soccer players.

Figure 3:
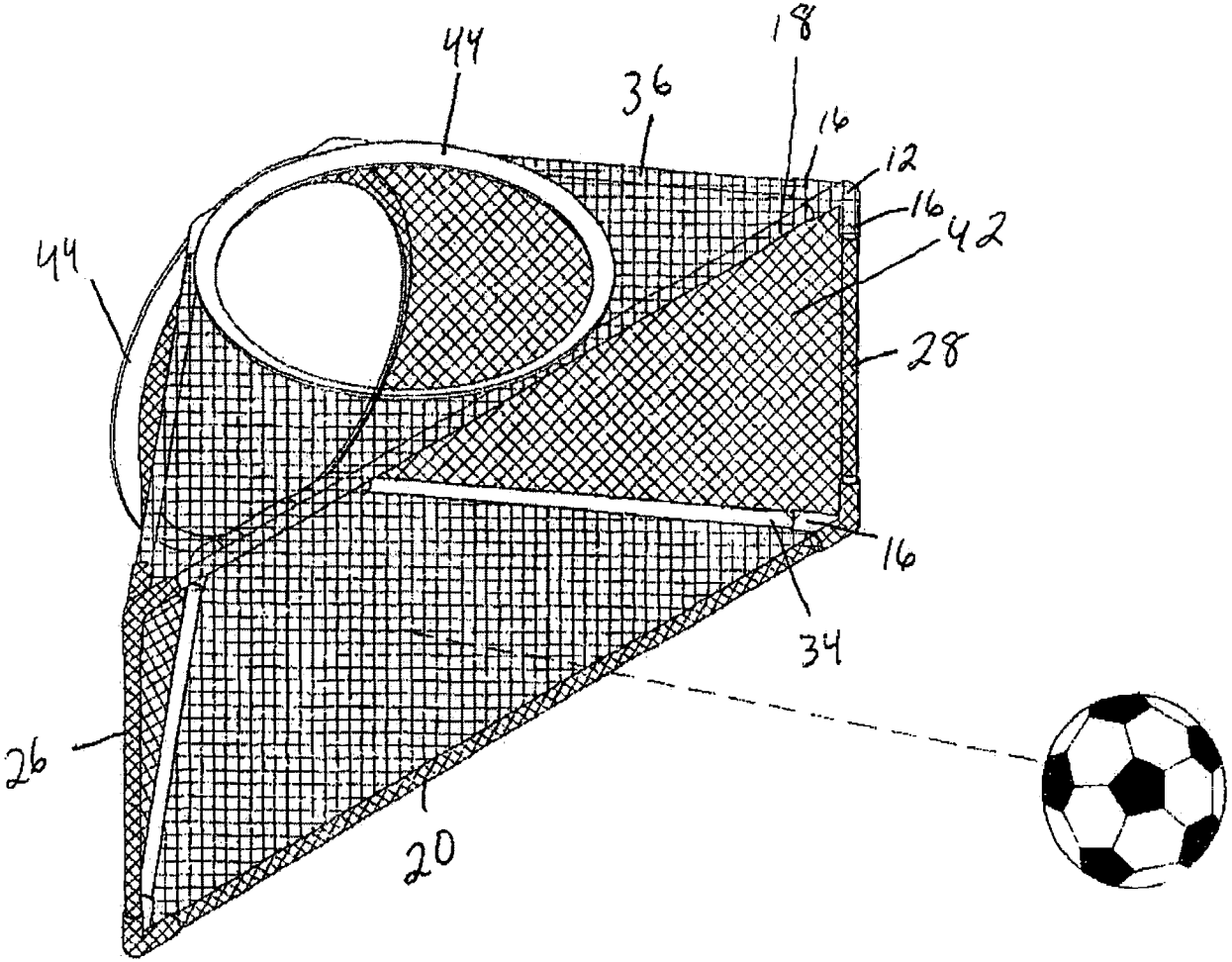

FIG. 3 is a bottom perspective view of the training device for soccer players.

Figure 4:
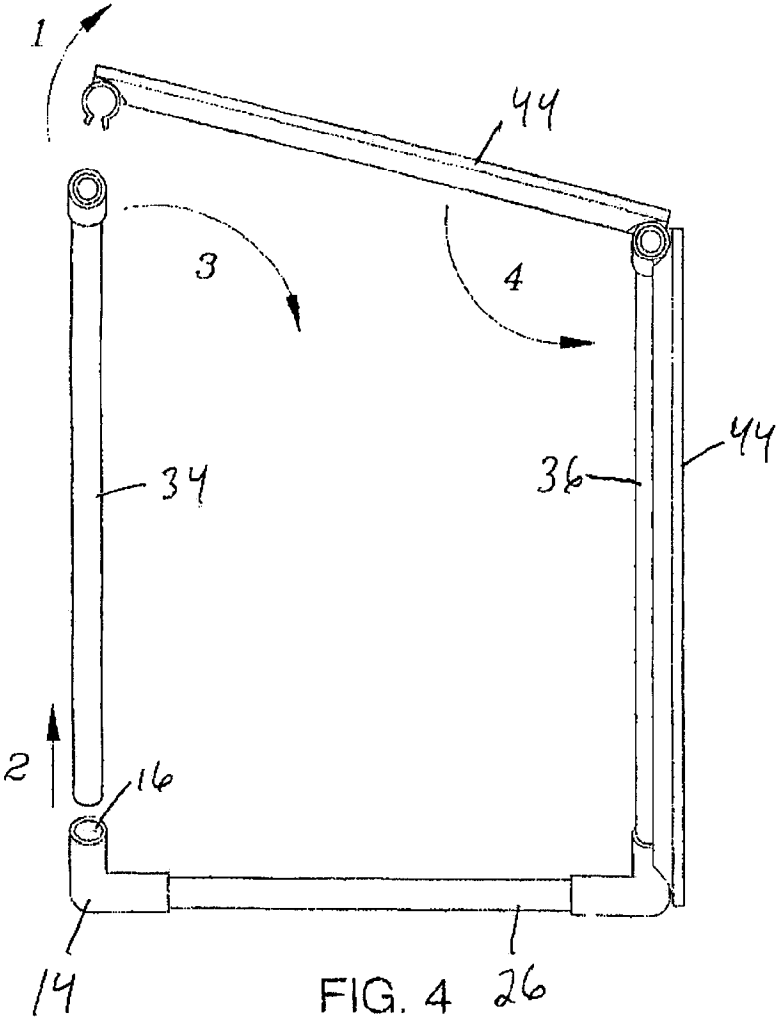

FIG. 4 is a side view of the unfolded frame of the training device for soccer players, with the outer covering removed for clarity, showing the rotation of the frame.

Figure 5:
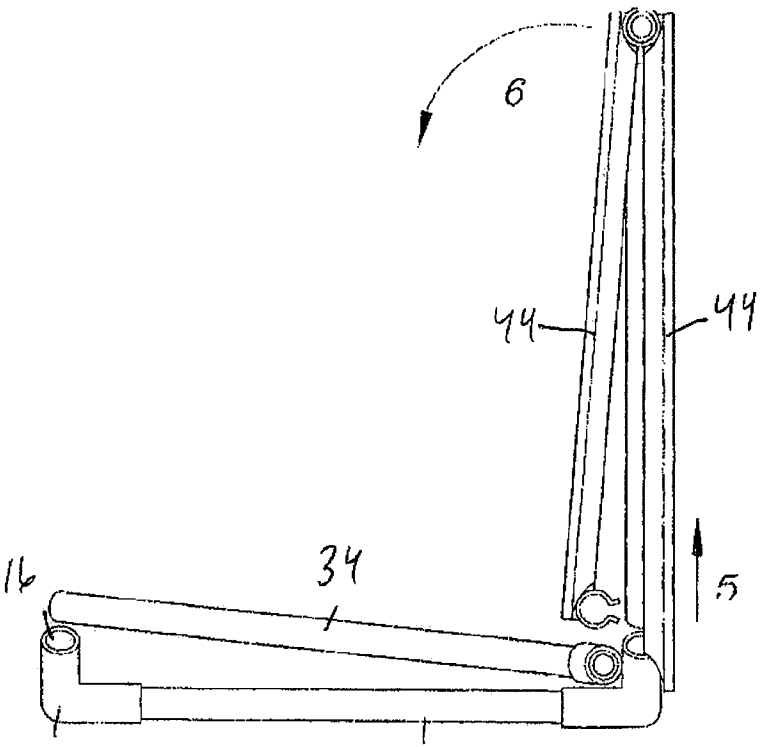

FIG. 5 is a side view of the folded frame of the training device for soccer players, with the outer covering removed for clarity, showing the rotation of the frame.

| REFERENCE NUMERALS | |
|---|---|
| connection means | 12 |
| main body | 14 |

-continued

| REFERENCE NUMERALS | |
|---|---|
| engagement ports | 16 |
| front and rear frame members | 18, 20 |
| opposite ends | 22, 24 |
| side frame members | 26, 28 |
| opposite ends | 30, 32 |
| upper frame members | 34, 36 |
| opposite ends | 38, 40 |
| flexible outer covering | 42 |
| ring member | 44 |
| opening | 46 |

The same reference numbers refer to the same parts throughout the various figures.

DETAILED DESCRIPTION OF THE PREFERRED EMBODIMENT

Referring now to the drawings, a preferred embodiment of the training device for soccer players of the present invention is shown and generally designated by the reference numeral 10.

In FIG. 1, a new and improved training device for soccer players 10 of the present invention for improving skills is illustrated and will be described. More particularly, the training device for soccer players 10 has a plurality of connection means 12 having a main body 14 and three hollow engagement ports 16. The connection means 12 are used at the corners to engage and support the frame members 18, 20, 26, 28, 34 and 36. The training device for soccer players 10 is shown with the frame assembled and the flexible outer covering 42 placed over the frame. The frame is formed from a pair of front and rear frame members 18 and 20, a pair of side frame members 26 and 28, and a pair of upper frame members 34 and 36. The front and rear frame members 18 and 20 have opposite ends 22 and 24, and the ends 22 and 24 are sized for reception in the engagement ports 16. The side frame members 26 and 28 have opposite ends 30 and 32, and the ends 30 and 32 are sized for reception in the engagement ports 16. The upper frame members 34 and 36 have opposite ends 38 and 40, and the ends 38 and 40 are sized for reception in the engagement ports 16. The ring members 44 placed within an opening 46 in the flexible outer covering 42 can be seen placed in both the side and the top of the flexible outer covering 42. The flexible outer covering 42 is shown as mesh in the Figures, but it is anticipated that any suitable material could be used as desired.

FIG. 2 is a left perspective view and shows the present invention as in use, with a soccer ball entering along the dashed line into the body of the training device for soccer players 10 through the side ring member 44. The placement of the ring members 44 in the opening 46 formed in the flexible outer covering 42 is shown more clearly. The plurality of connection means 12 having a main body 14 and three hollow engagement ports 16 are shown with the respective ends 22, 24, 30, 32, 38 and 40 of the frame members 18, 20, 26, 28, 34 and 36 inserted in the engagement ports 16. The training device for soccer players 10 is shown with the frame assembled and the flexible outer covering 42 placed over the frame. The frame is formed from a pair of front and rear frame members 18 and 20, a pair of side frame members 26 and 28, and a pair of upper frame members 34 and 36. The front and rear frame members 18 and 20 have opposite ends 22 and 24, and the ends 22 and 24 are sized for reception in the engagement ports 16. The side frame members 26 and 28 have opposite ends 30 and 32, and the ends 30 and 32 are sized for reception in the engagement ports 16.

FIG. 3 is a bottom perspective view showing the present invention as in use, with a soccer ball entering along the dashed line into the body of the training device for soccer players 10. In this Figure, an alternate method for using the training device is shown. The frame is placed with one of the upper frame members, 34 or 36, against the ground. The ball thus enters through what would be previously considered the bottom. This placement of the training device would be most useful for multiple players or long distance practice. The connection means 12, main body 14 and three hollow engagement ports 16 are shown in the corners and with the respective ends 22, 24, 30, 32, 38 and 40 of the frame members 18, 20, 26, 28, 34 and 36 inserted in the engagement ports 16. The flexible outer covering 42 is shown placed over the frame members 18, 20, 26, 28, 34 and 36 and supports ring members 44. The opening 46 through the flexible outer covering 42 is of a size to accommodate the entrance of a soccer ball.

FIG. 4 is a side view of the unfolded frame. The rotation of the frame members 18, 20, 26, 28, 34 and 36 within the hollow engagement ports 16 and the selective removal of the ends 22, 24, 30, 32, 38 and 40 from the hollow engagement ports 16 can be seen. To disassemble, the ring members 44 is lifted from the upper frame member 34 and the upper frame member 34 is then lifted from the engagement port 16. The upper frame member 34 is then placed inside the frame. The ring members 44 swivels down against the upper frame member 36.

FIG. 5 is a side view of the folded frame showing the frame disassembled as for transport or storage. The rotation of the frame members 18, 20, 26, 28, 34 and 36 within the hollow engagement ports 16 and the selective removal of the ends 22, 24, 30, 32, 38 and 40 from the hollow engagement ports 16 can be seen. The upper frame member 36 is removed from the hollow engagement ports 16, and the upper frame member 36 and ring members 44 are then placed inside the frame.

The inventor designed the present invention to aide in his coaching of soccer skills, as he had not found a product available that met all his needs. The device would be used to help players practice aimed shots both at the goal and in passing. The present invention can be used upright on the rectangular base and the player shoots for the circular ring opening, or tipped backwards with the frame positioned vertically, and the player shoots for the larger opening this provides. In the first use the player is closer to the goal and is working on finer control and aiming skills, and in the second use the player is likely farther away and is working on distance aiming skills.

In use, it can now be understood that the training device for soccer players provides a useful item for developing and practicing soccer aiming and passing skills. The frame can be quickly assembled, and conversely disassembled for storage. The connection means are a lightweight convenient method for assembling the frame and holding the ends so that the outer covering can be attached. The ring openings are used as the goal for aiming the ball into, and the ball then goes out the back for retrieval and further practice. The portability afforded by the present invention increases the opportunities available to a soccer player to practice. Additionally, the convenience of being able to quickly assemble, and disassemble and store the item adds to its attraction.

While a preferred embodiment of the training device for soccer players has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or plastic may be used for the connection means. Also, the outer covering may also be made of heavy-duty plastic, cloth, or similar material. And although use for increasing soccer players skills have been described, it should be appreciated that the training device for soccer players herein described is also suitable for training skills in any game or sport where accuracy with propelling a ball using the foot is valued.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A substantially right prism-shaped training device for soccer players comprising:

a plurality of connection means having a main body and three hollow engagement ports;

a pair of parallel elongated front and rear frame members having opposite ends, wherein said ends are sized for reception in said engagement ports;

a pair of parallel elongated side frame members having opposite ends, wherein said ends are sized for reception in said engagement ports;

a pair of upper frame members having opposite ends, wherein said ends are sized for reception in said engagement ports;

a flexible outer covering for placement over said members, the outer covering formed of mesh;

a pair of ring members placed within a plurality of openings through said flexible outer covering, each ring member swivelly attached to at least one of said upper frame members and said ring members having a different diameter, wherein one of said ring members is placed through a side opening of said flexible outer covering and one of said ring members is placed through a top opening of said flexible outer covering;

wherein the mesh is permanently attached to the ring member perimeter;

wherein said ring member placed through said side opening has a smaller diameter sized to receive a soccer ball and wherein said ring member placed through said top opening has a larger diameter sized to receive a basketball.

* * * * *